United States Patent [19]

Wolter

[11] 3,974,670

[45] Aug. 17, 1976

[54] TURNOVER KEY AND CORRESPONDING CYLINDER LOCK

[75] Inventor: Heinz Wolter, Cologne-Lindenthal, Germany

[73] Assignee: Josef Voss KG, Cologne, Germany

[22] Filed: Sept. 11, 1973

[21] Appl. No.: 396,247

[30] Foreign Application Priority Data

Sept. 4, 1973 Germany ..... 2344473

[52] U.S. Cl. ..... 70/364 A; 70/421; 70/419

[51] Int. Cl.[2] ..... E05B 27/00

[58] Field of Search ..... 70/364, 358, 364 A, 70/419, 420, 421

[56] References Cited

UNITED STATES PATENTS

| | | | |
|---|---|---|---|
| 3,035,433 | 5/1962 | Testa | 70/419 X |
| 3,349,587 | 10/1967 | Keller | 70/364 A X |
| 3,742,744 | 7/1973 | Lumme | 70/421 X |
| 3,777,520 | 12/1973 | Crepinsek | 70/364 A X |

FOREIGN PATENTS OR APPLICATIONS

| | | | |
|---|---|---|---|
| 903,157 | 9/1945 | France | 70/364 A |
| 260,517 | 3/1949 | Switzerland | 70/364 A |

*Primary Examiner*—Roy D. Frazier
*Assistant Examiner*—Peter A. Aschenbrenner
*Attorney, Agent, or Firm*—Ernest G. Montague; Karl F. Ross; Herbert Dubno

[57] ABSTRACT

A turnover key with indentations on both sides for operation of bolt keepers of a cylinder lock, and with a sloped keyway at the tip of the key. The sloped keyway, which is situated before each row of indentation, runs almost to the opposite broad side of the key and into it.

2 Claims, 5 Drawing Figures

Figure 5:
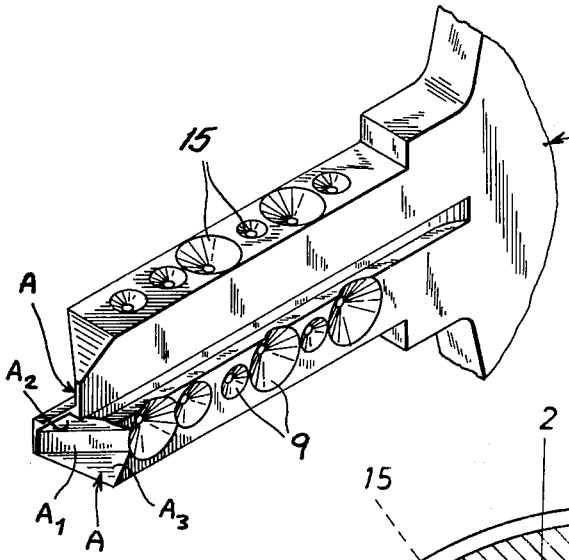

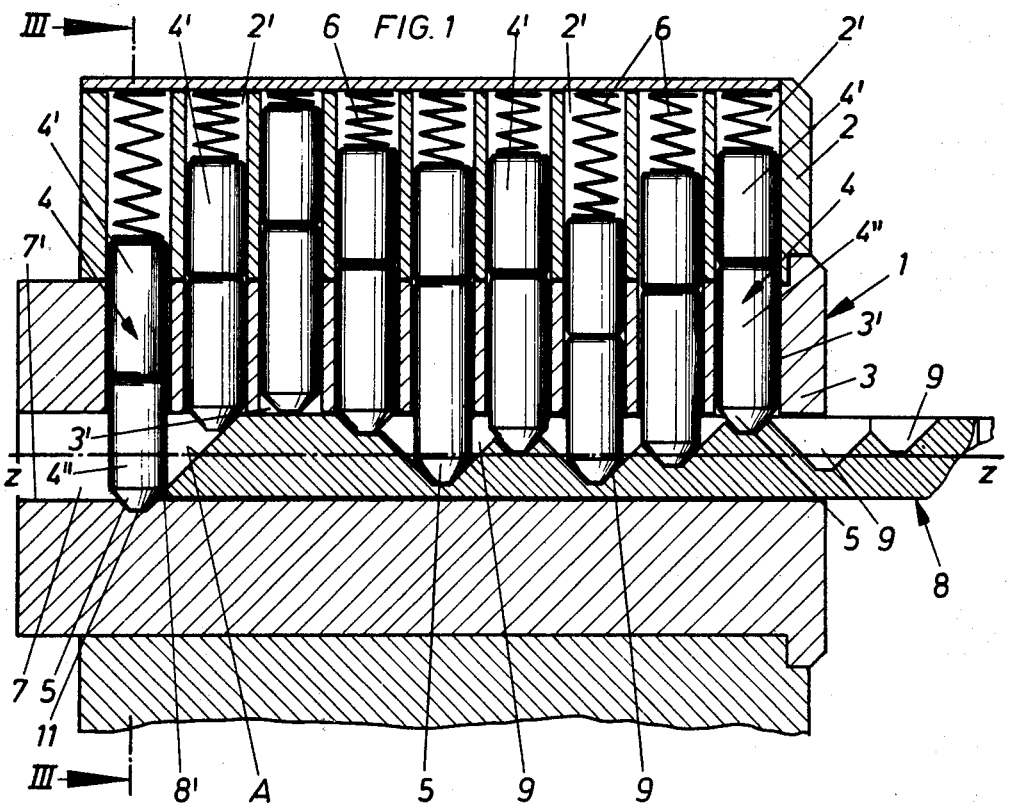
FIG. 2
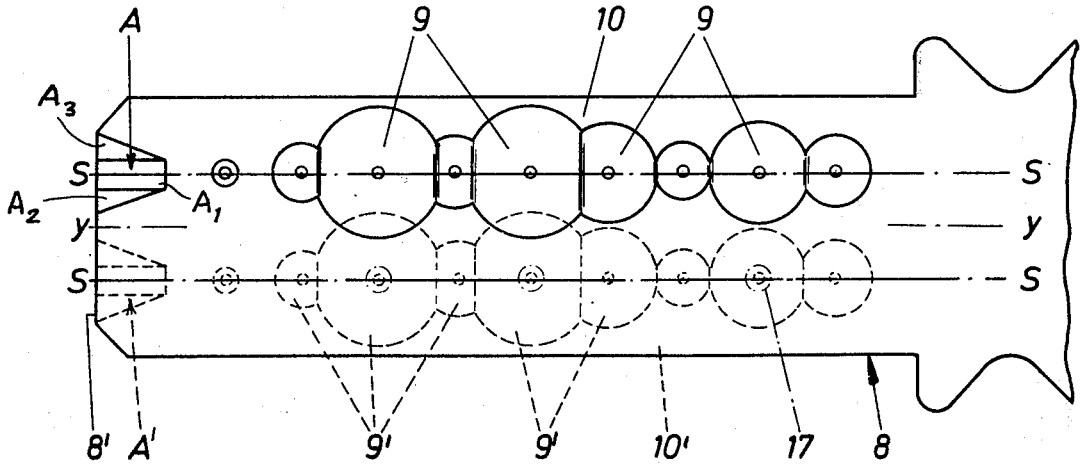

TURNOVER KEY AND CORRESPONDING CYLINDER LOCK

This invention relates to a turnover key with indentations on both broad sides of the key for operating bolt keepers of a cylinder lock, and with sloped keyways at the tip of the key.

Turnover keys with a single row or with multiple rows of indentations on both broad sides of the key are known. These turnover keys lock a cylinder lock even when the key is inserted completely reversed, (i.e. rotated by 180°). The key tip of these turnover key is equipped with two identical, sloped keyways which start at the center line of the key and extend all over the broad side of the key, usually at a 90° angle. The turnaround key must be 2 to 2.5 mm thick in order to allow for stability and the provision of an adequate number of sufficiently graded indentations. In order to lift a bolt keeper by its conical end with the keytip, a bolt keeper diameter of at least 4 mm is used because of the above mentioned thickness of the key. With the usual cylinder length of 25 mm this bolt keeper diameter only allows for a maximum of 4 bolt keepers. So called mushroom-type bolts have a tapered diameter, ranging from 3 to 2.5 mm. When the key is removed they settle in an indentation of the bolt bore. Then the bolt tip no longer touches the opposite wall of the key channel, once the key is removed. A considerable part of the indentation range is lost due to the design of this sort of turnover key, which anyway have very limited variations. The bolt keepers can no longer set deeply enough into the broad sides of the key for secure locking, and the depth of insertion can only slightly be moderated. Moreover, despite this elaborate design, only 5 bolts can be fitted in a reasonable length of cylinders. These designs do not offer optimal security against burglary.

The invention provides a turnover key which is easy to maufacture and to handle in such a way that, despite retention of the usual thickness of the key an increased number of bolt keepers can be provided, the settling depths are considerably increased, and there is an increase in number of variations of the individual bolt keepers. Furthermore, such a turnover key has to be coordinated with a cylinder lock which, in order to increase security against burglary and avoid lockpicking, even prevents the insertion of a differently shaped key.

Because of the improved design, described below, higher burglary-proofing is achieved with proper functioning. Practically almost the entire key can be used for the indentations. The increased depths of indentation, and thus the deeper settling of the bolt keepers into the key, not only bring about a good lock stability, but increases the number of choices from a wide selection of indentation possibilities for a stepped entry of the individual bolt keepers. The sloped keyway of the key for lifting the bolt keepers on insertion of the key always starts directly at the bottom of the key canal, no matter how the key is inserted. Thus even bolt keepers with smallest conical heads are safely lifted by the sloped keyway, and guarantee a safe and easy unlocking function. Relatively thin bolts can be used, and despite retention of the usual cylinder length, a large number of bolts can be inserted. It is quite possible to achieve such a design that other turnover keys, which do not correspond to the invention, cannot be inserted into the lock, when the tapering of the bolt starts relatively deep down at the bolt. The bolt keepers can protrude further than down to the bottom of the key canal, when the key is removed, i.e., even into indentations provided in the bottom of the key canal. Only a small portion of the conical head should protrude into the key canal in order to allow for lifting by means of the sloped keyway on the keytip. The manufacture of a turnover key corresponding to the invention is possible in a simple way. Each groove and the corresponding sloped keyway on the keytip can be manufactured with the same tool in one sequence of operation. The grooved design of the sloped keyway complicates the falsification of a key, even if the burglar knows that the lock can only be opened by a key of a design corresponding to the invention.

If the grooved keyways are not exactly aligned with the bolt keepers, the blank cannot be inserted. The sloped keyway prevents a different type of key from being inserted and damaging the delicate bolts. The erroneous insertion of a non-fitting key can be avoided, even when the aligning sloped keyways and bolt indentations should accidentally coincide with the bolt keeper sequence of the lock, because the sloped keyway aligned with the conical heads of the bolts, only allows insertion of a key, when the shape of the conical tips coincides with that of the notch. Possible damage to the lock which could occur if the bolt keepers or conical heads were larger than the indentations of the key provided, is avoided. The symmetrical sidewise displacement to the center line of the key does not bring about a decrease in key stability, despite the numerous indentations for settling of the bolt keepers. The noncentric design of the key canal to the cylinder core axis adds the advantage of a radial orientation of the bolt keepers. The bolts can thus be cylindrically shaped; there are no elaborately fitted surface shape at the separation joints between upper and lower bolt; moreover, the bolts can turn in their bore without influencing the proper function of the lock. Additional security and an increased number of lock variations and/or lock functions of the key can be achieved by means of a number of additional bolts which simply are loosely inserted, and can only enter into the key canal to a certain extent.

Figure 3:
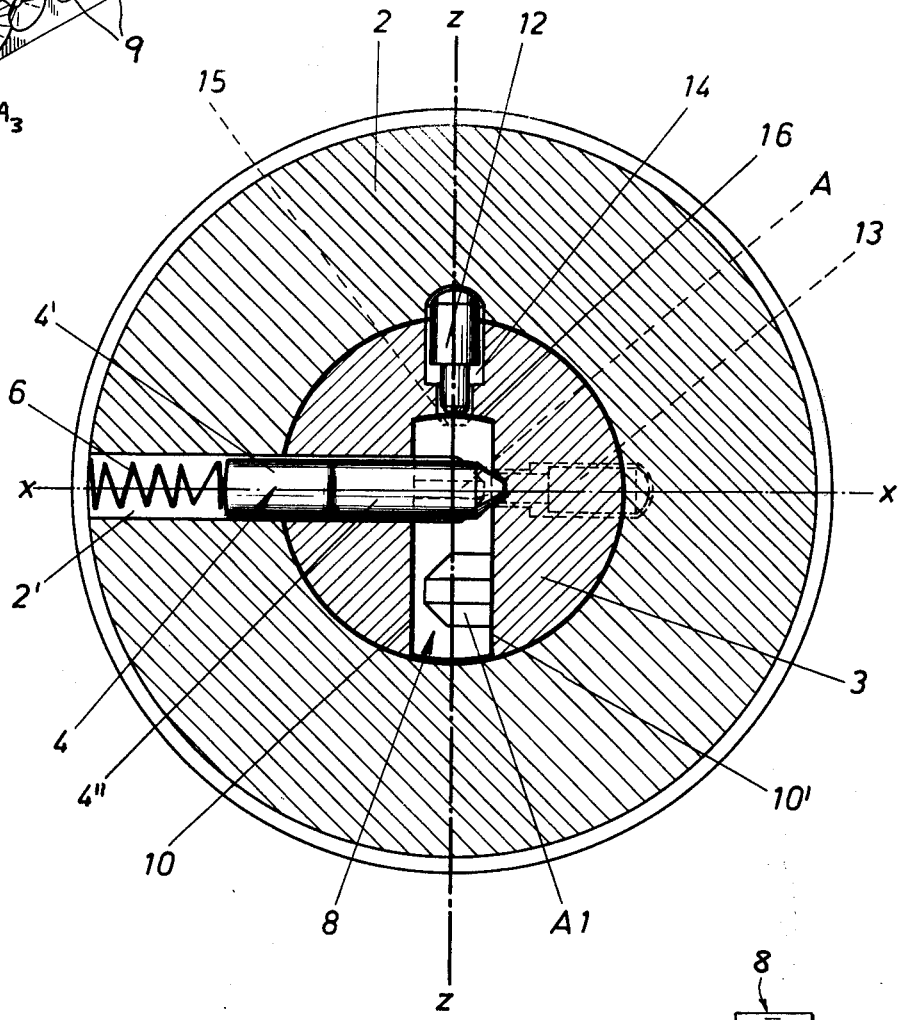
Figure 4:
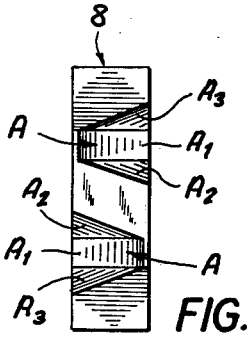

The object of the invention is further described by reference to the drawing in which:

FIG. 1 is a longitudinal axial sectional view of a cylinder lock corresponding to the invention, with partially inserted turnover key corresponding to the invention, FIG. 2 is a fragmentary plan view of the broad side of a keyblade corresponding to the invention, FIG. 3 is a cross-section taken in the plane represented at III—III of FIG. 1, FIG. 4 is a fragmentary end view of the key, FIG. 5 is a perspective view of the key.

FIG. 1 is a longitudinal view of the cylinder lock 1. Lock housing 2 and cylinder core 3 have aligning bores 2', 3', which receive the bolt keepers 4. The bore 2' of the lock housing 2 supports the upper section of the bolt 4' and the corresponding bores 3' of the cylinder core 3 supports the lower bolt 4'' which is equipped with a conical head 5. The bolt keepers 4 are spring-loaded towards the cylinder core by pressure springs 6.

The key canal of the cylinder core 3 is asymmetric to the cylinder core axis, X—X. This key receives the turnover key 8. The key 8 has indentations 9 or 9' on the broad side 10 or 10' which are symmetric at about the center line y—y of the key. At the front end of the key tip there is a grooved sloped ramp or keyway A or A′ in line with the center of the indentations R or R′. The keyway runs from one broad side 10 or 10′ to the other broad side 10 or 10′. The grooved keyways A or A′ are aligned cross section with the conical heads of the bolt keepers 4.

The bolts 4 can even be lifted near the key canal 7 bottom by these grooved keyways A or A′. It is thus possible to start the conical tapering below the longitudinal center plane z—z of the key canal. Even a partial section of the bolt heads 5 can enter into the corresponding indentations 11 of the key canal 7′. Although the section of a conical head 5 reaches into the far side of the key canal 7 the sloped keyway can slip underneath to unlock the bolt keepers. The keyways A and A′, inwardly of the blade edge, each have a ramp $A_1$ of rectangular plan (receiving the small base of the frustoconical tip 5 and aligned therewith) extending between the broad-face planes of the key blade and a pair of downwardly and inwardly converging flanks $A_2$ and $A_3$ lying to either side of the ramp $A_1$ and of triangular plan configuration.

In order to render the lock still more burglarproof, and to increase the number of lock variations, pins 12 and/or 13 are inserted, either loosely or springloaded in blind holes 14 of the cylinder core, in addition to the bolt keepers which are already divided into upper and lower bolt. These additional pins are tapered. This is why they only protrude very little into the key canal, and thus they can be controlled without the keyways. The bolts 12 are arranged in such a way that they can enter into corresponding indentations (not shown) in the narrow side or edges of the key blade. The bolts 13, however, are situated on the cylinder core side 3 opposite the bolt keepers. They enter into the corresponding indentations 17 of the broad side of the key, opposite the indentations 9/9′. These additional pins 12 and 13 are completely inaccessible due to this design, and are almost invisible from the outside as they are hidden by the bolts 4 which completely fill the cross-section of the key canal.

I claim:

1. A lock system comprising:

a cylinder having a first axis of rotation, said cylinder being formed with a narrow elongated key channel having a second axis of symmetry offset from said first axis;

a row of first keeper pins mounted in said cylinder and movable transversely to said channel while lying in a plane perpendicular to the broad dimension of said channel and offset from said second axis, said pins having conical tips entering into said channel and being displaceable outwardly therefrom to permit rotation of said cylinder about said first axis; and a key having an elongated blade with beveled edges receivable in said channel and formed along opposite broad faces of the blade with a row of indentations offset from said second axis and adapted to receive said tips upon insertion of said blade in said channel to enable rotation of said cylinder by said key about said first axis, said key being receivable in said channel in two positions offset by 180° about said second axis from one another, said blade having a leading end formed with a respective keyway along each row of indentations and spaced inwardly from the edges of the blade, said keyways each extending forwardly from the broad surface formd with a respective row of indentations to the opposite broad surface of the blade and comprising a ramp of rectangular plan configuration and a pair of flanks converging rearwardly and toward the respective ramp, said tips being frustoconical with small bases fitting between said flanks and said flanks having a convergence corresponding to the taper of said tips, said tips beginning opposite the longitudinal plane of the channel from their mounting in said cylinder, said first keeper pins extending fully across said channel.

2. The system defined in claim 1 wherein other pins are provided in said cylinder adapted to penetrate into said channel at right angles to said first keeper pins for engagement with said key.

* * * * *